US005877794A

United States Patent [19]

Takagi

[11] Patent Number: 5,877,794

[45] Date of Patent: Mar. 2, 1999

[54] METHOD FOR SUPPLYING INK TO AN INK JET RECORDING DEVICE

[75] Inventor: Jun Takagi, Ebina, Japan

[73] Assignee: Fuji Xerox Co., Ltd., Tokyo, Japan

[21] Appl. No.: 712,269

[22] Filed: Sep. 11, 1996

Related U.S. Application Data

[62] Division of Ser. No. 208,110, Mar. 9, 1994, Pat. No. 5,682, 189.

[30] Foreign Application Priority Data

Mar. 9, 1993 [JP] Japan ..... HEI. 5-72848

[51] Int. Cl.[6] ..... B41J 2/01

[52] U.S. Cl. ..... 347/87

[58] Field of Search ..... 347/85–87

[56] References Cited

U.S. PATENT DOCUMENTS 5,010,354 4/1991 Cowger et al. ..... 347/87

5,070,346 12/1991 Mochizuki et al. ..... 347/7

FOREIGN PATENT DOCUMENTS 59-500609 4/1984 Japan .

1-148559 9/1989 Japan .

*Primary Examiner*—Benjamin R. Fuller

*Assistant Examiner*—Craig A. Hallacher

*Attorney, Agent, or Firm*—Finnegan, Henderson, Farabow, Garrett & Dunner, L.L.P.

[57] ABSTRACT

An ink tank has a main ink chamber which is hermetically sealed and communicated with an ink jet head connected to a lower portion of the main ink chamber, through a communicating passage, and in which ink is to be contained, and an auxiliary ink chamber which is communicated with a lower space of the main ink chamber through a communicating passage. A porous member is packed in the auxiliary ink chamber.

1 Claim, 4 Drawing Sheets

METHOD FOR SUPPLYING INK TO AN INK JET RECORDING DEVICE

This is a division of application U.S. Ser. No. 08/208,110, filed Mar. 9, 1994 now U.S. Pat. No. 5,682,189, issued Oct. 28, 1997.

BACKGROUND OF THE INVENTION

1. Field of the Invention

The invention relates to an ink supply device for supplying ink to an ink jet recording apparatus, and particularly to a novel ink supply device which is intended to stabilize the ink supply performance and suppress the influence of a change of environment.

2. Discussion of the Related Art

Conventionally, a known ink supply device used in an ink jet recording apparatus has a configuration wherein the entire internal space of an ink tank communicated with an ink jet head is charged with an ink absorber made of sponge or felt, which is a fibrous material, the ink absorber is previously impregnated with ink to retain the ink, and the ink is in the ink absorber is supplied to the ink jet head.

In an ink supply device of this type, however, ink is retained by the capillary force of the ink absorber. Therefore, the amount of available ink is about 40 to 60% of the content capacity of the ink tank at the most so that the utilization efficiency is fundamentally low. Moreovor, the attempt of prolonging the service life of the ink tank inevitably causes the ink tank to have a large size, thereby producing a technical problem in that the requirement for miniaturization is not fulfilled.

Furthermore, when the amount of ink which is to be retained by the ink absorber is decreased as a result of consumption of ink, the negative pressure acting on the ink contained in the ink absorber is increased. The increased negative pressure is apt to hinder the operation of supplying the ink to the ink jet head, thereby arising a fear that printing nozzles of the ink jet head conduct the ink ejection operation under the state where no ink is supplied to the head. As a result, another technical problem is produced in that air bubbles are liable to enter backward from the printing nozzles to cause image defects.

In order to solve these technical problems, ink supply devices have been proposed in which a sealed ink tank, having a non-variable or fixed internal volume, contains ink only and is communicated with capillary tubes each having one end that opens in the atmosphere (for example, Japanese Patent Unexamined National Publication No. Sho 59-500,609, and Japanese Patent Unexmined Publication No. Hei 1-148,559).

In an ink supply device of this type, when the negative pressure of the ink tank is increased as the ink in the ink tank is consumed, air is introduced into the ink tank through the capillary tubes. This allows the negative pressure to be maintained at a substantially constant level, so that the ink in the ink tank is stably supplied to the ink jet head.

When environment is changed so that, for example, the air in the upper space of the ink tank is expanded, the ink in the ink tank is moved into the capillary tubes. Consequently, a situation in which ink leaks from the ink jet head is effectively prevented from occurring.

Since the sealed ink tank is communicated with a cell through capillary tubes of a substantial length, however, such an ink supply device is complicated in configuration by, for example, the provision of capillary tubes which are required to be suitably bent. Even in the case where the negative pressure of the ink tank is increased as the ink in the ink tank is consumed, furthermore, the introduction of air bubbles through the capillary tubes is made more uncertain when the capillary tubes are clogged by dust or dried ink. As a results, a further technical problem is produced in that the negative pressure of the ink tank is liable to become unstable and it is difficult to stably supply the ink to the ink jet head.

SUMMARY OF THE INVENTION

The invention has been conducted in order to solve the above-mentioned technical problems. It is an object of the invention to provide an ink supply device for an ink jet recording apparatus in which the efficiency of accommodating ink is enhanced, the performance of supplying ink to an ink jet head is stabilized, and the influence of a change of environment is surely suppressed while fulfilling the requirements of simplifying and miniaturizing the configuration of the device.

The above objection of the invention has been achieved by provision of an ink supply device for an ink jet recording apparatus which comprises an ink tank communicated with an ink jet head, and in which ink contained in said ink tank is supplied to the ink jet head, wherein said ink tank comprises: a main ink chamber, of non-variable or fixed internal volume, which is hermetically sealed and communicated with said ink jet head connected to a lower portion of said maim ink chamber, through a communicating passage, and in which ink is to be contained; and an auxiliary ink chamber which is communicated with a lower space of said main ink chamber through an open communicating passage, an air communicating port being opened in an upper portion of said auxiliary ink chamber, and a porous member is packed in said auxiliary ink chamber.

In the ink supply device of the invention, only ink is contained in the main in chamber of the ink tank, and ink permeates the porous member of the auxiliary ink chamber to be held therein. Therefore, both the main ink chamber and the auxiliary ink chamber can function as an ink container, thereby improving the ink accommodiation efficiency of the ink tank.

When the pressure of the negative pressure space of the main ink chamber is disposed to be lowered de the ink is consumed, the porous member packed in the auxiliary ink chamber allows air bubbles to be introduced into the main ink chamber through the capillary tube portions of the porous member, so that the negative pressure of the negative pressure space of the main ink chamber is kept to a substantially constant level. Accordingly, the pressure of the ink supplied to the ink jet head can always be kept constant, whereby the ink supply performance can be stabilized.

When the air in the negative pressure space of the main ink chamber is expanded by a change of environment, an extrusion force acts on the ink as the increase of the pressure of the negative pressure space. However, the porous member in the auxiliary ink chamer allows the ink to permeate thereinto so that the ink in the main ink chamber can temporarily escape into the auxiliary ink chamber. Consequently, the increased capacity of the negative pressure space enables the pressure of the negative pressure space to be returned to the stabilized level, whereby the leakage of ink from the ink jet head can surely be avoided.

Since the ink supply device has a configuration in which the ink tank comprises the main ink chamber and the auxiliary ink chamber and the porous member is packed in the auxiliary ink chamber, there is no fear that the configuration is complicated to a degree in excess of that needed and the device itself is enlarged.

The above and other objects and features of the present invention will be more apparent from the following description taken in conjunction with the accompanying drawings.

DETAILED DESCRIPTION OF THE PREFERRED EMBODIMENTS

Hereinafter, the invention will be described in detail by illustrating embodiments shown in the accompanying drawings.

Figure 1:
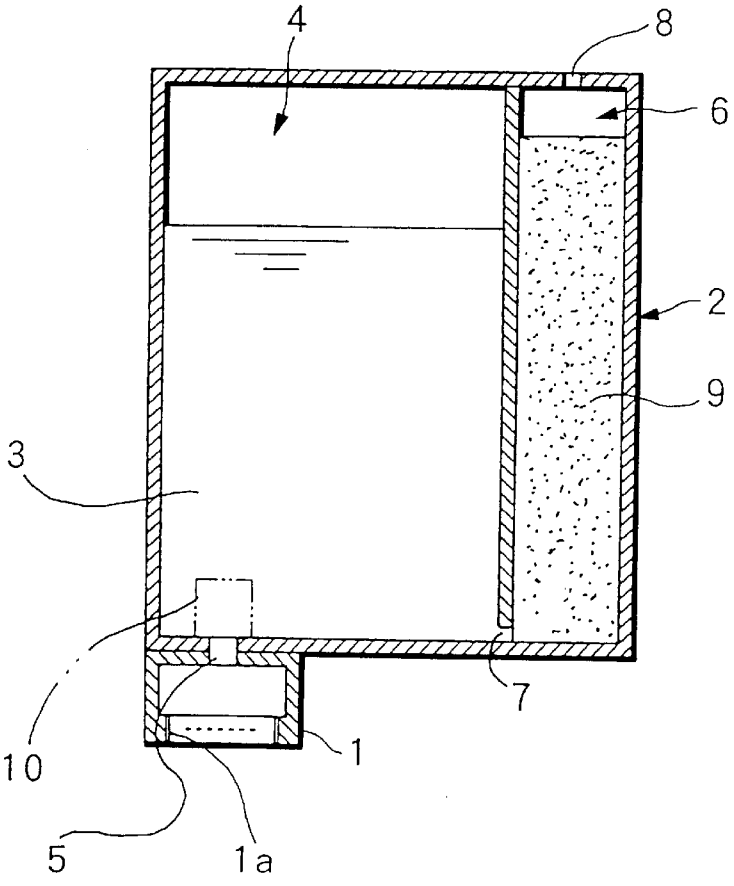
FIG. 1 is a diagram illustrating the configuration of the ink supply device for an ink jet recording apparatus according to the inventions

FIG. 1 shows an ink jet recording apparatus according to the invention, which includes an ink tank 2 communicated with an ink jet head 1, and in which ink 3 contained in the ink tank 2 is supplied to the ink jet head, and characterized in that the ink tank 2 comprises: a main ink chamber 4 which is hermetically sealed and communicated with the ink jet head 1 connected to a lower portion of the main ink chamber, through a communicating passage 5 and in which ink 3 is to be contained, and an auxiliary ink chamber 6 which is communicated with a lower space of the main ink chamber 4 through a communicating passage 7, an air communicating port 8 is opened in an upper portion of the auxiliary ink chamber, and a porous member 9 is packed in the auxiliary ink chamber 6.

In such technical means, the ink jet head 1 may be integrated with the ink tank 2, or detachably mounted to the ink tank 2. The system of ejecting ink from the ink jet head 1 may be adequately selected from various systems such as that thermal energy corresponding to an image signal is supplied to the ink 3 so that the ink 3 is ejected by the growth of an air bubble, that the ink 3 is ejected by an electrostatic force corresponding to an image signal, and that vibration corresponding to an image signal is applied by a piezoelectric element to eject the ink 3. The ink tank 2 may be made of any kind of a material as far as the material is ink-resistant. In the view point of allowing the residual ink 3 in the tank to be visually observed, it is preferable to construct the whole or a part of the ink tank 2 by a transparent or translucent member.

The shape and layout of the main ink chamber and the auxiliary ink chamber 6 may be determined arbitrarily, providing that the auxiliary ink chamer 6 is in open fluid flow communication with the lower space of the main ink chamber 4 through the communicating passage 7.

In this case, the main ink chamber 4 and the auxiliary ink chamber 6 may be disposed in a single ink tank case, or separately disposed in plural ink tank cases. The disposition of both the ink chambers 4 and 6 in a single ink tank case may be realized by, for example, dividing the internal space of the ink tank 2 with a partition member into the main ink chamber 4 and the auxiliary ink chamber 6 (the chambers may be arranged in parallel, or one of them is surrounded by the other), or vertically partitioning a portion of the main ink chamber 4 to form therein the auxiliary ink chamber 6. Particularly, in the latter type, a cylindrical member for defining the auxiliary ink chamber 6 may be vertically suspended from the upper wall of the man ink chamber 4, and the lower end portion of the cylindrical member is separated from the lower wall of the main ink chamber. Alternatively, a retaining portion composed of a porous member 9 may be disposed in the ink tank 2 and a covering member of the porous member 9 may constitute the peripheral wall of the auxiliary ink chamber 6.

A hole which is opened at a lower portion of the partition member between the main ink chamber 4 and the auxiliary ink chamber 6 may be used as the communicating passage 7. In the case where the main ink chamber 4 and the auxiliary ink chamber 6 are separated from each other, the communicating passage 7 may be a communicating member by which the two chambers are connected.

In consideration of the accommodation efficiency for the ink 3, it is preferable to set the capacity of the main ink chamber 4 to be as large as possible. The pressure or the negative pressure space in the upper portion of the main ink chamber 4 is varied by a change of environment. With due regard to this pressure variation, the ink chambers must be designed so that the amount of overflowing ink due to the pressure variation is effectively absorbed by the porous member 9 in the auxiliary ink chamber 6.

As the porous member 9, any member having a number of pores which can produce capillary action may be adequately used. For example, the porous member 9 may be composed of fiber bundles each containing a plurality of fibers, a felt-like member having a two- or three-dimensional structure of a fibrous material, or an open cell sponge material.

The lower end portion of the porous member 9 may reach the bottom face of the auxiliary ink chamber 6. In this configuration, the lower end portion of the porous member 9 is kept soaked in ink until the level of the ink 3 in the ink tank 2 is lowered to the lowest portion, and therefore the in 3 retained in capillary tube portions of the porous member 9 is prevented from being dried until the level of the ink 3 is lowered to the lowest portion, whereby the negative pressure of the main ink chamber 4 is kept to a substantially constant level.

The air bubble formation function (refer to the column of function below) of the porous member 9 causes air bubbles to enter from the auxiliary ink chamber 6 to the main ink chamber 4 through the communicating passage 7. In the view point of surely avoiding a situation in which the air bubbles move toward the ink jet head 1, it is preferable to locate the opening end in the side of the main ink chamber 4 of the communicating passage 7 so as to be separated from the communicating passage 5 to the ink jet head 1, or alternatively dispose an air bubble block member between the opening end in the side of the main ink chamber 4 of the communicating passage 7, and the communicating passage 5 connected to the ink jet head 1.

During scanning operations of the ink jet head 1, the ink tank 2 moves together with the ink jet head 1. Therefore, the level of the ink 2 in the ink tank 2 vibrates, thereby arising a fear that air bubbles are formed. In the view point of effectively suppress the formation of air bubbles, it is preferable to design the device in such a manner that a plurality of ribs are formed in a projecting manner on the inner wall of the main ink chamber 4 so as to suppress the vibration the ink 3. In this case, the plurality of ribs can function also as the above-mentioned air bubble block member.

In the view point of effectively avoiding the ingress of air into the ink tank 2 through the communicating passage 5 connected to the ink jet head 1, and the leakage of ink from the ink jet head 1 caused by the vibration of the ink in the ink tank 2, it is preferable to charge the communicating passage 5 which is connected to the ink jet head 1, with an ink absorber 10.

In the technical means described above, preferably, the state of the ink supply device at the beginning of its use is set as follows: In the view point of efficiency, the main ink chamber 4 is filled with the ink 3, and, in the view point of forming a back pressure in the capillary action which will be described later, the auxiliary ink chamber 6 is filled with the ink 3 at a level in the vicinity of the full (or approximately filled) in such a manner that there is a portion which is not charged with the ink 3, in the upper portion of the porous member 9 of the auxiliary ink chamber 6.

In such a state, when the ink jet head 1 conducts the printing operation, the ink 3 of the ink tank 2 is consumed. At this time, the ink 3 in the auxiliary ink chamber 6 is gradually decreased, and finally the auxiliary ink chamber 6 is emptied except the portion in the vicinity of the communicating passage 7.

When the ink 3 is consumed, air in the form of bubbles is introduced into the main ink chamber 4 from the ink-air interface which is formed in a number of capillary tube portions existing in the porous member 9. This causes the internal pressure of the man ink chamber 4 to be raised to return to the predetermined level.

When the air In the upper space of the main ink chamber 4 is expanded by a change of environment, the ink 3 is moved from the main ink chamber 4 to the auxiliary ink chamber 6.

In this way, according to the invention, the ink-air interface is always formed in the porous member 9 which can easily retain the ink 3, and therefore the ink 3 in the capillary tube portions of the porous member 9 is hardly dried. Consequently, the internal pressure of the main ink chamber 4 is stably maintained irrespective of the variation of the ink-air interface which may be caused by the raised or lowered internal pressure of the main ink chamber 4.

Figure 2:
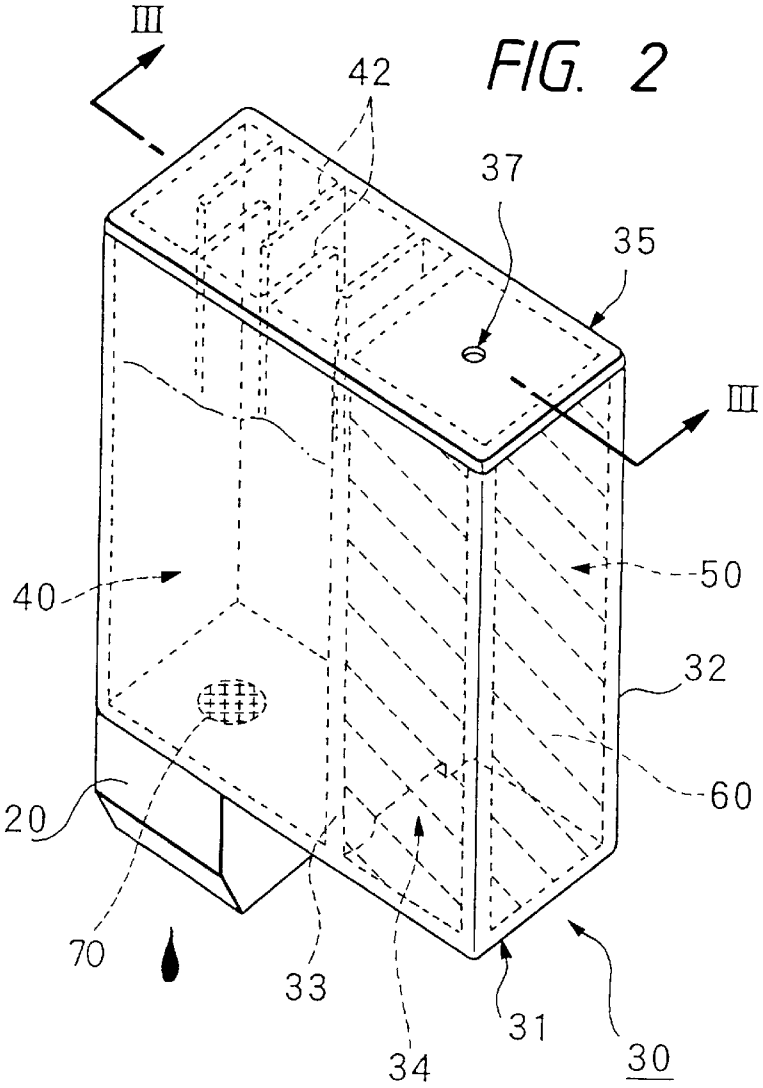
FIG. 2 is a perspective view showing an outline of an ink supply device for an ink jet recording apparatus according to a first embodiment.
Figure 3:
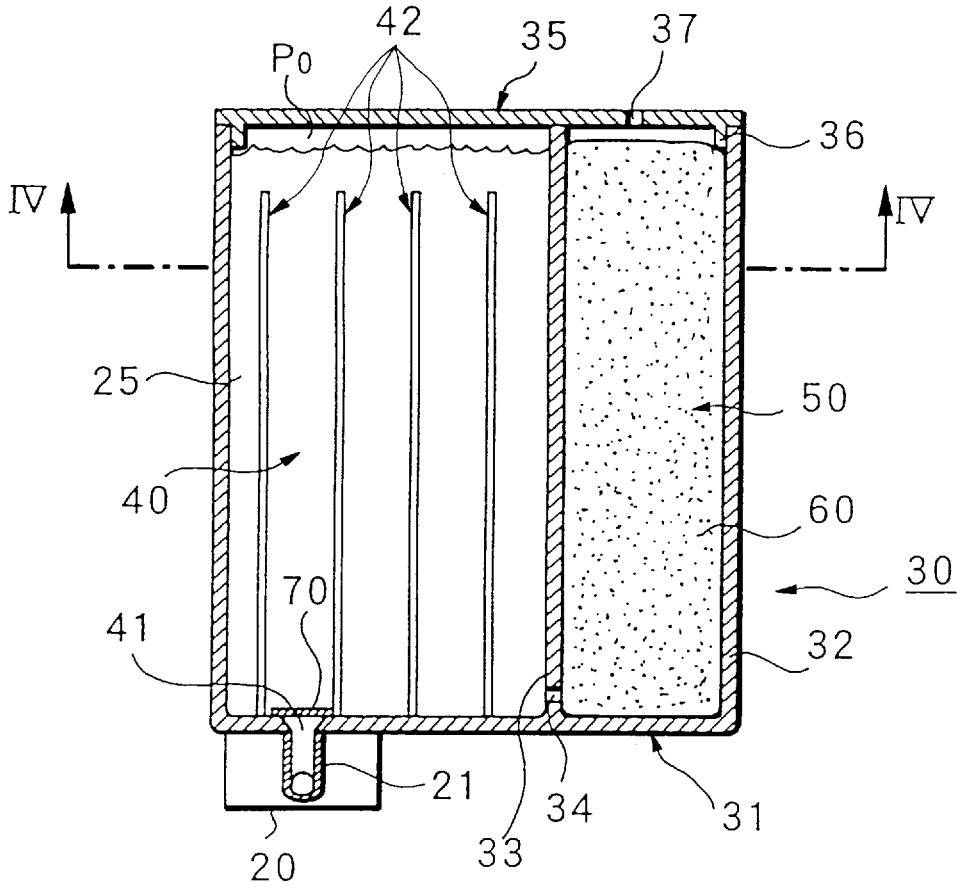
FIG. 3 is a sectional view taken along line III—III of FIG. 2.
Figure 4:
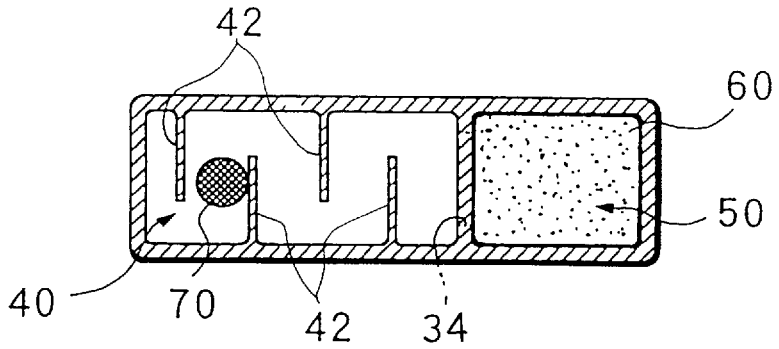
FIG. 4 is a sectional view taken along line IV—IV of FIG. 3.

FIGS. 2 to 4 show an ink supply device for an ink jet recording apparatus according to a first embodiment.

Referring to the figures, the ink supply device comprises an ink tank 30 which is communicated with an ink jet head 20.

In the embodiment, for example, the ink jet head 20 has a configuration in which thermal energy corresponding to an image signal is applied to ink in each nozzle to form an air bubble and ink is ejected by the air bubble.

The ink tank 30 is made of an ink-resistant material, and consists of the tank body 31 which opens upward and a lid member 35 for closing the upper opening of the tank body 31.

In the tank body 31 used in the embodiment, a partition wall 33 is disposed in a standing manner at a portion of the. internal space of a box-like outer case 32 so that the space is partitioned by the partition wall 33 into a main ink chamber 40 and an auxiliary ink chamber 50.

A communicating hole 41 is opened at a portion of the lower wall of the main ink chamber 40, and the ink jet head 20 is integrally communicated and connected to the communicating hole 41 through an ink supply pipe 21. A plurality of ribs 42 are integrally formed in a projecting manner on the two side walls of the main ink chamber 40 which elongate in the width direction, in such a manner that the ribs are directed to the respective opposing side wall or the ribs are alternately arranged so as to form two sets of comb-like teeth which engage with each other.

On the other hand, the lid member 35 comprises at the peripheral edge a projection 36 which is to be fitted into the tank body 31. An air communicating hole 37 is opened at a position corresponding to the auxiliary ink chamber 50.

Furthermore, a communicating hole 34 through which the main ink chamber 40 and the auxiliary ink chamber 50 are communicated is opened at a lower portion of the partition wall 33.

In the embodiment a porous member 60 is packed in the auxiliary ink chamber 50. The porous member 60 is similar to a core material for a marking pen, and has a number of capillary tube portions. The porous member 60 can be produced by, for example, mixing heat-fusion polyester fibers functioning as a binder and conventional polyester fibers, forming a bundle of the fibers having a predetermined size, and then fusing the fibers.

Alternatively, the porous member 60 may be made of a mixture of polypropylene fibers, acrylic fibers, nylon fibers, or the like. The material of the fibers may be suitable selected in accordance with congeniality to the used ink.

More specifically, the porous member 60 is packed in the auxiliary ink chamber 50 in such a manner that a small space is formed in the upper portion of the chamber, and the member closely contacts with the peripheral wall of the chamber. The porous member 60 contacts with the lower end portion of the auxiliary ink chamber 50. Therefore, an air flow passage is not formed at the interface between the porous member 60 and the peripheral wall of the auxiliary ink chamber 50, so that the main ink chamber 40 is communicated with the atmospheric pressure region through only the capillary tube portions of the porous member 60.

The capacity of the auxiliary ink chamber 50 is adequately selected depending on environmental conditions such as the temperature, and the atmospheric pressure. When it is assumed that the substantial utilization efficiency (=water retention×utilization efficiency) of the porous member 60 is about 60%, the capacity of the auxiliary ink chamber 50 may be about 50% of that of the main ink chamber 40.

In the embodiment, a dust-proof filter 70 is bonded by ultrasonic fusion or thermal fusion to an opening of the communicating hole 41 communicated with ink jet head 20 which opening is in the side of the main ink chamber 40.

The dust-proof filter 70 has meshes or pores which attain the filtration grit of about 5 to 50 $\mu$m. Specifically, a material obtained by forming SUS meshes or SUS thin wires into a felt-like member and then subjecting it to a compression-sintering process is used as the base material of tho dust-proof filter 70.

Next, the performance of the ink supply device of the embodiment will be evaluated.

First, the printing quality of printing operations of the ink let head was checked. As a result, very excellent printings in which printing failures such as blur were not entirely observed were obtained until the ink 25 was completely consumed.

The internal pressure of the main ink chamber 40 during the printing operations was checked, with the result that it was confirmed that the internal pressure was maintained at a substantially constant level.

In the embodiment, moreover, it was confirmed that the dust-proof filter 70 effectively prevents dust (such as fibers of the porous member 60) in the ink 25 from entering the ink jet head 20.

Since the plural ribs 42 formed in the main ink chamber 40 suppress the vibration of the ink 25 during scanning operations of the ink jet head 20, the formation of air bubbles due to the vibration of the surface of the ink 25 is effectively prevented from occurring. Moreover, the ribs 42 prevent also the phenomenon that air bubbles entering from the porous member 60 are moved to the ink jet head 20, from occurring.

Figure 5:
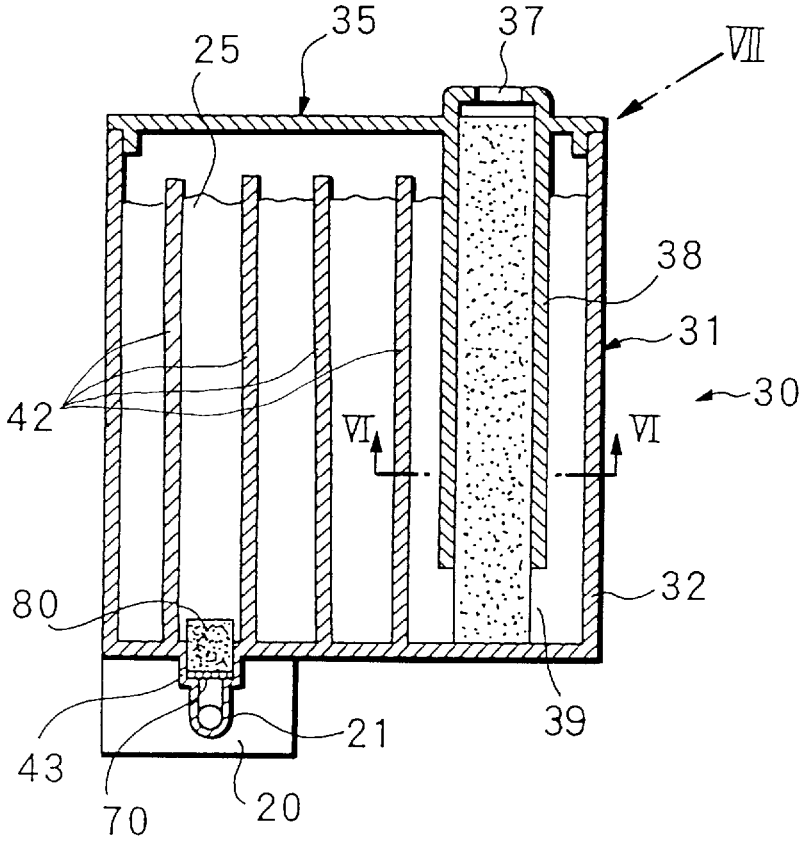
FIG. 5 is a sectional view simlar to FIG. 3 and showing an ink supply device for an ink jet recording apparatus according to a second embodiment.
Figure 6:
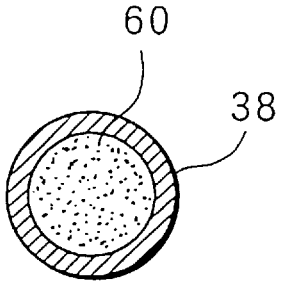
FIG. 6 is a sectional view taken along line VI—VI of FIG. 5.
Figure 7:
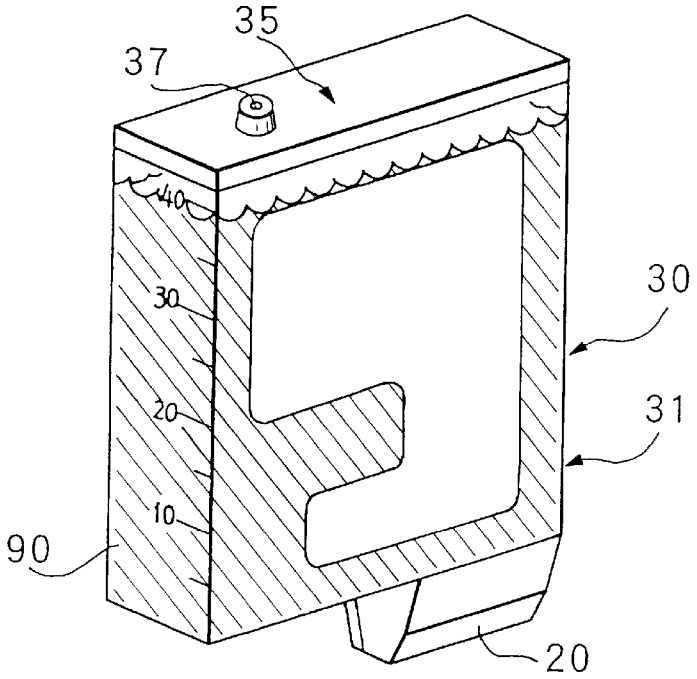
FIG. 7 is a view as seen from arrow VII of FIG. 5.

FIGS. 5 to 7 show an ink supply device according to a second embodiment of the invention.

Referring to the figures, in the same manner as Embodiment 1, the ink supply device comprises the ink tank 30 which is communicated with the ink jet head 20 through the ink supply pipe 21, and the ink tank 30 is formed by two separate members, i.e., tank body 31 and the lid member 35. However, the configuration of the ink tank 30 is different from that of Embodiment 1. The components similar in configuration to those of Embodiment 1 are designated by the same reference numeral, and their detailed description is omitted.

The tank body 31 of the ink tank 30 used in the embodiment comprises only the box-like main ink chamber 40. On the other hand, for example, a cylindrical pipe 38 is integrally formed at a portion of the lid member 35 which faces the air communicating hole 37, in such a manner that the cylindrical pipe is vertically suspended from the lid member. The lower end of the cylindrical pipe 38 is separated from the lower wall of the main ink chamber 40. In the embodiment, the cylindrical pipe 38 defines the auxiliary ink chamber 50, and a gap 39 between the cylindrical pipe 38 and the lower wall of the main ink chamber 40 functions as the communicating passage between the auxiliary ink chamber 50 and the main ink chamber 40. The porous member 60 is packed in the cylindrical pipe 38 in such a manner that the periphery of the porous member closely contacts with the cylindrical pipe. The lower end portion of the porous member 60 contacts with the lower wall of the main ink chamber 40.

A recess portion 43 is formed at a portion of the lower wall of the main ink chamber 40, so as to protrude downward. In the bottom of tho recess portion 43, the communicating hole 41 connected to the ink jet head 20 is opened, and the dust-proof filter 70 is disposed. An ink absorber 80 (in the embodiment, the ink absorber is made of the material same as that of the porous member 60) is attached on the dust-proof filter 70 so as to be fitted into the recess portion 43.

In the embodiment, as shown in FIG. 7, the tank body 31 is constructed by a transparent or translucent member, and a scale 90 for indicating the residual amount of ink is formed on a portion of the outer case 32.

In the ink supply device of the embodiment, accordingly, the upper opening of the tank body 31 is closed by the lid member 35 after the porous member 60 is packed in the cylindrical pipe 38 which is in the side of the lid member 35, thereby constituting the ink supply device.

Then, the ink supply device is initially filled with the ink 25 and achieves the same effects as Embodiment 1.

Since the ink absorber 80 is disposed in the communicating hole 41 connected to the ink jet head 20, the embodiment can achieve the following further effects.

First, even when the ink tank 30 is tilted, the ink absorber 80 maintains the state in which the ink 25 permeates the absorber, so that an air flow passage is not formed between the negative pressure air space of the main ink chamber 40 and the ink jet head 20. Even if a vibration or a shock is applied to the device, therefore, air is prevented from easily moving from the nozzles of the ink jet head 20 into the ink tank 30. In other words, the ink absorber 80 functions as a liquid seal.

Second, even in the case where the level of the ink 25 is caused to vibrate by any external action, the pressure acts through the ink absorber 60 on the ink in the nozzles of the ink jet head 20. Consequently, the vibration of the ink 25 is attenuated by the function of the pressure buffer member, and the ink retaining force due to the meniscus of the nozzles is prevented from being broken, whereby the leakage of ink from the nozzles is effectively avoided.

Figure 8:
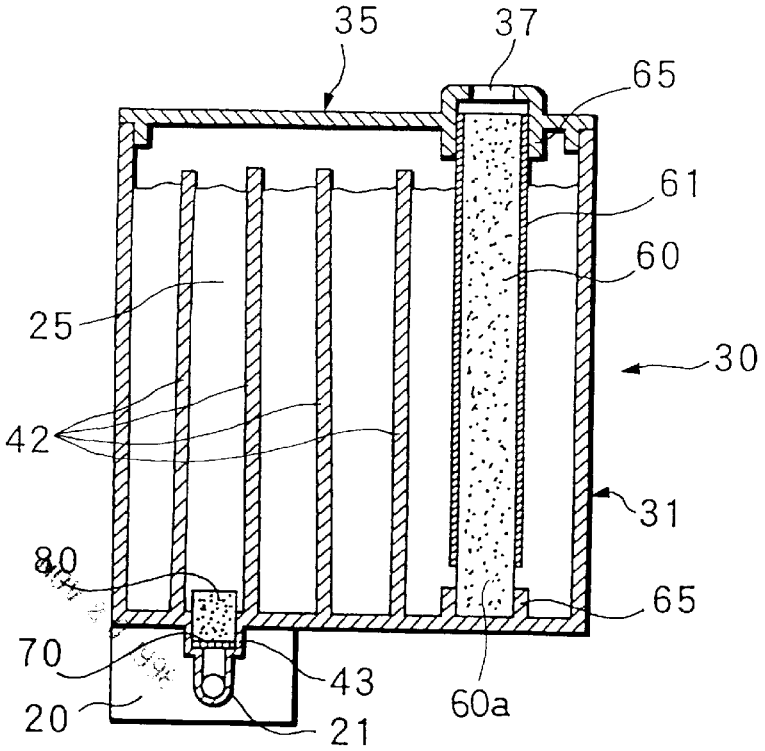
FIG. 8 is a sectional view similar to FIG. 5; and showing an ink supply device for an ink jet recording apparatus of a modification of the second embodiment.

FIG. 8 shows a modification of Embodiment 2. Holding portions 65 for the porous member 60 are disposed at portions of the tank body 31 and the lid member 35. On the other hand, the periphery of the porous member 60 except the lower end portion 60*a*may be covered by an ink-nonpermeable covering member 61, so that the porous member 60 covered by the covering member 61 is held by the holding portions 65 of the ink tank 30.

In this case, the covering member 61 of the porous member 60 functions as the peripheral partition member for the auxiliary ink chamber 50.

The functions of the auxiliary ink chamber 50 in which the porous member 60 is packed are roughly classified into two ones.

One of these functions is that the ink contained within an ink tank 2 is prevented from being leaked to the exterior when the ambient temperature and the atmospheric pressure are fluctuated. The volume of the auxiliary ink chamber 50 in which the porous member 60 is packed is determined according to some computation expression so as to prevent the leakage of the ink within the ink tank to the exterior. In the case of constituting an auxiliary ink chamber with the function similar to the present invention by a simple capillary shown in FIG. 1A of U.S. Pat. No. 4,791,438 (corresponding to Japanese Patent Unexamined Publication No. Hei 1-148559), the capillary require the sufficient volume to absorb the volume fluctuation, that is, a very length itself. Therefore, it becomes difficult to receive such a long capillary within the ink tank. On the other hand, the structure of the invention can simultaneously satisfy a necessary capillary action and a required volume.

The other function of the auxiliary ink chamber according to the invention is that the inner pressure of the ink tank is always maintained to a given negative pressure. When the inner pressure within the ink tank exceeds a predetermined negative pressure, the meniscus on the top of the capillary is destroyed thereby allowing an air to enter into the ink tank from the exterior. In this case, if the ink chamber is formed of a simple capillary, since the number of meniscuses is one, it is very unstable against vibration or impact. When this meniscus is destroyed, then the inner pressure within the ink tank is made equal to the atmosphere, as the result of which the ink leakage from the head occurs. However, in the case where a porous member, that is, an assembly of capillaries is used for the auxiliary ink chamber, because countless meniscuses are formed in the auxiliary ink chamber, even though a part of the meniscuses is destroyed, it does not affect the maintaining of the negative pressure within the ink tank.

In addition, in an auxiliary ink chamber shown in FIGS. 1B and 1C of U.S. Pat. No. 4,791,438 (Japanese Patent Unexamined Publication), the ambient temperature or the atmospheric pressure is fluctuated many times, ink which bas been moved to the auxiliary ink chamber can return to the main ink chamber. As a result, there rises a problem that the use efficiency or ink is lowered. Furthermore, U.S.P. discloses an ink chamber using a plurality of parallel plane plates. Such a chamber must be manufactured in such a manner that a distance between the adjacent parallel plane plates is uniformly set to approximately 0.1 mm, resulting in difficulty in manufacturing. On the other hand, according to the invention, the density of the porous member disposed within the auxiliary ink chamber is set to a desired one whereby a capillary action can be controlled relatively easily. Further, this porous member holds ink and prevents bubbles from entering into the ink tank from the top of the capillary, that is, air communicating hole even when the ink tank is inverted.

Next, the volume necessary for the auxiliary ink chamber will be described. There are roughly two conditions under which printing is obstructed.

One of these conditions is that, when the negative pressure within the ink tank is too increased, refilling of ink into the head is obstructed, as the result of which a printing may be blurred. However, when the pressure within the ink tank is increased, since bubbles are supplied from the auxiliary ink chamber to the main ink chamber due to a give difference in pressure between the interior and the exterior, there results in no significant problem.

The other condition is that, when the negative pressure within the ink tank is too decreased, ink rises from the head surface (face flood), and in the worst case, ink leakage occurs. The worst condition causing this phenomenon is that the ink remaining quantity within the ink tank is substantially zero, with a result that the circumstance is changed from a high pressure to low pressure, from a low temperature to a high temperature. In this case, as the change admissible quantity, if the quantity of change in atmospheric pressure is $\Delta P$, the quantity of change in temperature is $\Delta T$ and the capacity of the ink chamber is X(cc), then the air volume within the ink chamber is X(cc). If the static pressure of the head in an initial state (immediately after printing) is ZmmH20, since 1 atm is 10332 mmH20, the quantity of change in the outer pressure until the face flood occurs becomes $(\Delta P-(Z/10332))$ atm.

The subsequent volume change is considered to be a change in a constant-pressure volume. If PV=constant=nRT, the quantity of ink leakage corresponds to the quantity of change in this volume, the changed volume is V1, and the quantity of change is $\Delta V1$, then $\Delta V1=(\Delta P-(Z/10332))V$. Further, since the quantity of change in temperature $\Delta T$ contributes to the volume expansion, if the change volume is V2, and the quantity of change is $\Delta V2$ and an initial temperature is T, then $\Delta V2$ is $(\Delta T/(2\Omega 3+T))\cdot\nabla$ where, since the quantity of change in ink vapor pressure also contributes to the volume expansion, the quantity of change in volume is $\Delta V3$.

If the quantity of change in the total volume is $\Delta V4$ when taking the influence of changes in air pressure, temperature, and vapor pressure into consideration, V4 is $\Delta V1+\Delta V2+\Delta V3=(\Delta P-(Z/10332))V+\nabla\cdot\Delta T/(273+T)+\Delta V3$. Therefore, the quantity of the volume expansion is $X((\Delta P-(Z/10332))V+(V\cdot\Delta T/(273+T)+\Delta V3)(cc)$ (hereinafter referred to as "b"). If the inner volume of the auxiliary ink chamber is Y (cc), (X+Y) is equal to 1. If the actual use efficiency of the felt is a %, $aY\leqq bX$ in order to absorb the quantity of the volume expansion. Thus, it is necessary to set the size of the auxiliary ink chamber to the value of $Y\leqq Xb/a$.

If $\Delta P=0.15$ atm, Z=50 mmHg, the quantity of change in temperature $\Delta T=45°$ C. (25° C.–70° C.), $\Delta V3=0.28V$ and a=60% at this temperature change, then $0.6Y\leqq 0.575X$, that is, $Y\leqq 0.96X$. Thus, it is found that the size of the auxiliary ink chamber is substantially equal to or larger than the main ink chamber.

As described above, the ink supply device according to the invention achieves the following fundamental effects.

First, only ink is contained in the main ink chamber of the ink tank, and ink permeates the porous member of the auxiliary ink chamber to be held therein. Therefore, both the main ink chamber and the auxiliary ink chamber can function as an ink container, thereby improving the ink accommodation efficiency of the ink tank.

Second, when the predecessor of the negative pressure space of the main ink chamber is disposed to be lowered as the ink is consumed, the porous member packed in the auxiliary ink chamber allows air bubbles to be introduced into the main ink chamber through the capillary tube portions of the porous member, so that the negative pressure of the negative pressure space of the main ink chamber is kept to a substantially constant level. Accordingly, the pressure of the ink supplied to the ink jet head can always be kept constant whereby the ink supply performance can be stabilized.

Third, when the air in the negative pressure space of the main ink chamber is expanded by a change of environment, an extrusion force acts on the ink as the increase of the pressure of the negative pressure space. However, the porous member in the auxiliary ink chamber allows the ink to permeate thereinto so that the ink in the main ink chamber can temporarily escape into the auxiliary ink chamber. Consequently, the increased capacity of the negative pressure space enables the pressure of the negative pressure space to be returned to the stabilized level, whereby the leakage of ink from the ink jet head can surely be avoided.

Fourth, since the ink supply device has a configuration in which the ink tank comprises the main ink chamber and the auxiliary ink chamber and the porous member is packed in the auxiliary ink chamber, there is no fear that the configuration is complicated to a degree in excess of that needed and the device itself is enlarged.

Further, according to the invention, since the lower end portion of the porous member contacts with the lower end portion of the auxiliary ink chamber, the state in which the porous member is soaked in ink is maintained until the ink level reaches the substantially lowest portion. Consequently, the porous member can surely conduct the above-mentioned air-bubble introducing function and ink-escaping function until the ink 25 is completely consumed, Still further, according to the invention, since the porous member is composed of fiber bundles, the configuration of the porous member can be simplified, and the volume of the porous member can be conducted easily.

Still further, according to the invention, the partition member is adequately formed inside the ink tank so that the main ink chamber and the auxiliary ink chamber are formed. Therefore, the main ink chamber and the auxiliary ink chamber can be secured in a very simple manner.

Still farther, according to the invention, a cylindrical amber for defining the auxiliary ink chamber is vertically suspended from the upper wall of the main ink chamber, and the lower end portion of the cylindrical member is separated from the lower wall of the main ink chamber. Therefore, when the ink tank is divided into, for example, the tank body and a lid member and the cylindrical member in integrated with the lid member, the ink supply device can easily be constructed by closing the tank body with the lid member having the cylindrical member in which a porous member is packed.

Still further, according to the invention, since the peripheral wall of the auxiliary ink chamber is constructed by a covering member of the porous member, it is not required to dispose a peripheral partition member for the auxiliary ink chamber in the ink tank, whereby tie configuration of tho ink tank can be simplified.

Still further, according to the invention, an opening end in the side of the auxiliary ink chamber of the communicating passage which elongates between the main ink chamber and the auxiliary ink chamber is located at a position which is separated from the communicating passage which is connected to the ink jet head. Even if an air bubble enters from the porous member into the ink, therefore, it is possible to surely avoid the situation in which the air bubble enters to the ink jet head to cause a printing failure.

Still further, according to the invention, since a plurality of ribs are formed in a projecting manner on an inner wall of the main ink chamber, it is possible to effectively avoid the situation in which, during the scanning operation of the ink jet head, ink vibrates at a degree in excess of that needed and air bubbles are formed, and also to effectively avoid the situation in which air bubbles entering from the porous member move toward the ink jet head.

Still further, according to the invention, the communicating passage which is connected to the ink jet heed is charged with an ink absorber. Even if a vibration or a shock is applied to the device, therefore, the liquid sealing function of the ink absorber can effectively prevent the situation in which air enters from the nozzles of the ink jet head into the ink tank, from occurring. Furthermore, the vibration of the ink in the ink tank can be attenuated by the pressure buffer function of the ink absorber, and the ink retaining force due to the meniscus of the nozzles is prevented from being broken, whereby the leakage of ink from the nozzles is effectively avoided.

The foregoing description of a preferred embodiment of the invention has been presented for purposes of illustration and description, It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the inaction be defined by the claims appended hereto, and their equivalents.

What is claimed is:

1. A method of supplying ink to an ink jet recording apparatus in communication with a main ink chamber and an auxiliary ink chamber, comprising the steps of:

supplying ink to the ink jet recording apparatus from said main ink chamber that is in open fluid communication with said auxiliary ink chamber at lower portions of both said main ink chamber and said auxiliary ink chamber, the auxiliary ink chamber being filled with porous material;

filling the auxiliary ink chamber partially with ink from the main ink chamber so that an upper portion of the porous material contains no ink;

venting the upper portion of the porous material to atmosphere;

reducing the amount of ink in the auxiliary ink chamber by passage of ink from the auxiliary ink chamber to the main ink chamber; and introducing an air bubble to the main ink chamber from the auxiliary ink chamber when the ink in the porous member is consumed, the air bubble being formed by air passed through the porous member.

* * * * *